US008944274B2

(12) United States Patent
Madrid

(10) Patent No.: US 8,944,274 B2
(45) Date of Patent: Feb. 3, 2015

(54) WASTEBASKET FOR FACILITATING REUSE OF PLASTIC SHOPPING BAGS

(71) Applicant: James Madrid, El Paso, TX (US)

(72) Inventor: James Madrid, El Paso, TX (US)

( * ) Notice: Subject to any disclaimer, the term of this patent is extended or adjusted under 35 U.S.C. 154(b) by 0 days.

(21) Appl. No.: 13/919,661

(22) Filed: Jun. 17, 2013

(65) Prior Publication Data

US 2014/0367389 A1 Dec. 18, 2014

(51) Int. Cl.
*B65D 25/14* (2006.01)
*B65F 1/06* (2006.01)

(52) U.S. Cl.
CPC ..... *B65F 1/062* (2013.01); *Y10S 220/9081* (2013.01)
USPC ..... 220/495.07; 220/23.87; 220/495.01; 220/495.05; 220/495.06; 220/495.08; 220/495.11; 220/908.1; 206/505

(58) Field of Classification Search
CPC ..... B65D 25/14; B65D 25/16; B65F 1/06; B65F 1/062; B65F 1/067; B65F 2001/061; B65F 2220/12
USPC ..... 220/495.01, 495.05, 495.06, 495.07, 220/495.08, 495.11, 908, 908.1, 908.3, 220/23.87, 23.89; 206/505, 514, 519, 520
See application file for complete search history.

(56) References Cited

U.S. PATENT DOCUMENTS

| | | | |
|---|---|---|---|
| 180,277 | A | 7/1876 | Sghmitt |
| 641,592 | A | 1/1900 | Johnson |
| 1,679,621 | A | 8/1928 | Myers |
| 1,698,683 | A | 1/1929 | Reynolds |
| 1,840,616 | A | 1/1932 | Burke |
| 2,624,451 | A | 1/1953 | Ewing |
| 3,378,134 | A | 4/1968 | Wilkinson |
| 3,459,295 | A | 8/1969 | Cousar |
| 4,153,155 | A | 5/1979 | Benno |
| 4,204,597 | A | 5/1980 | Fischer |
| 4,509,641 | A | 4/1985 | Scieri |
| 4,684,015 | A | 8/1987 | Vezirian |
| 4,763,809 | A | 8/1988 | Miller |
| 4,858,781 | A | 8/1989 | Kane |
| 4,936,481 | A | 6/1990 | Rosenfeld |
| 4,991,737 | A | 2/1991 | Edelman |
| 5,088,618 | A | 2/1992 | Colombo |
| 5,160,063 | A | 11/1992 | Bailey |
| 5,186,329 | A | 2/1993 | Fogelberg |
| 5,294,017 | A | 3/1994 | Li |
| 5,322,179 | A | 6/1994 | Ting |
| 5,328,050 | A | 7/1994 | Hyatt |
| D353,925 | S | 12/1994 | Freedland |
| 5,392,942 | A | 2/1995 | Hanson |
| 5,405,041 | A | 4/1995 | Van Brackle |

(Continued)

*Primary Examiner* — Jeffrey Allen
*Assistant Examiner* — Madison L Poos
(74) *Attorney, Agent, or Firm* — Wayne J. Colton, Inc.

(57) ABSTRACT

A wastebasket for facilitating reuse of plastic shopping bags includes a first, open topped receptacle; a second receptacle, sized and shaped to receive therein the first receptacle; and a lid. The first, open topped receptacle may be formed unitary with the second receptacle or the first, open topped receptacle may be removable from the second receptacle. The first, open topped receptacle and the second receptacle are cooperatively adapted to form a bag storage compartment generally within the second receptacle and about the outside, upper portions of the first receptacle. The lid is cooperatively adapted with the first, open topped receptacle and the second receptacle to form an aesthetically pleasing closure for the bag storage compartment while simultaneously providing an also aesthetically pleasing opening to the interior space of the first, open topped receptacle.

6 Claims, 10 Drawing Sheets

(56) References Cited

U.S. PATENT DOCUMENTS

| | | | | |
|---|---|---|---|---|
| 5,467,890 | A | 11/1995 | Hussey | |
| 5,503,292 | A | 4/1996 | Cuccharia | |
| 5,560,486 | A | 10/1996 | Zak | |
| 5,632,401 | A | 5/1997 | Hurd | |
| D381,159 | S | 7/1997 | Hampton | |
| 5,662,239 | A | 9/1997 | Heuvelman | |
| D411,676 | S | 6/1999 | Cantrell | |
| 5,971,194 | A * | 10/1999 | Freedland | 220/495.08 |
| 6,000,571 | A | 12/1999 | Brooks | |
| 6,123,215 | A | 9/2000 | Windle | |
| 6,126,031 | A | 10/2000 | Reason | |
| 6,301,824 | B1 | 10/2001 | Ashlock | |
| 6,364,147 | B1 | 4/2002 | Meinzinger | |
| 6,386,409 | B1 | 5/2002 | Cheney | |
| 6,971,539 | B1 | 12/2005 | Abbe | |
| 6,981,606 | B2 | 1/2006 | Yang | |
| 7,204,407 | B2 | 4/2007 | Laher | |
| 7,225,943 | B2 | 6/2007 | Yang | |
| 7,273,155 | B1 | 9/2007 | Gray | |
| 7,401,708 | B2 | 7/2008 | Lin | |
| 7,510,098 | B2 | 3/2009 | Hartjes | |
| 7,513,386 | B2 | 4/2009 | Hartjes | |
| 7,624,874 | B2 | 12/2009 | Douglas | |
| 7,694,838 | B2 | 4/2010 | Yang | |
| 7,748,556 | B2 * | 7/2010 | Yang et al. | 220/263 |
| D623,370 | S | 9/2010 | Kuo | |
| 7,922,023 | B2 | 4/2011 | Dommerholt | |
| 7,922,024 | B2 | 4/2011 | Yang | |
| 7,992,742 | B1 * | 8/2011 | Kim | 220/495.08 |
| 8,061,554 | B2 | 11/2011 | Shikano | |
| 2003/0189052 | A1 | 10/2003 | Greiner | |
| 2006/0016817 | A1 | 1/2006 | Sheppard | |
| 2009/0223386 | A1 | 9/2009 | Edwards | |

* cited by examiner

WASTEBASKET FOR FACILITATING REUSE OF PLASTIC SHOPPING BAGS

FIELD OF THE INVENTION

The present invention relates to environmentally conscious refuse disposal. More particularly, the invention relates to a wastebasket particularly adapted with specific provisions for facilitating the reuse of plastic shopping bags without sacrifice of aesthetically pleasing design features, thereby encouraging greater reuse of such plastic shopping bags.

BACKGROUND OF THE INVENTION

While plastic shopping bags are inexpensive and convenient in use, they are by many accounts considered an environmental nightmare of a very grand scale. To be sure, by some estimates, over a billion plastic shopping bags are used each year in the United States alone. With a recycling rate estimated at less than 1%, disposal of plastic shopping bags creates some 300,000 tons of landfill waste annually. Because such shopping bags are not biodegradable, but are subject to degradation under light, they tend to break down over time into smaller and smaller particles that are expensive and difficult, if even possible, to remove, thus causing persistent soil and groundwater contamination.

Unfortunately, the cost of recycling one ton of plastic shopping bags can reach some $4,000, while the recycled product has a market value of as little as thirty dollars. Given the unlikelihood that consumers and retailers will forego the low cost convenience afforded by plastic shopping bags compounded by financial impracticability of recycling, any other solution is desperately needed. With that in mind, it is an overriding object of the present invention to promote environmentally conscious refuse disposal. To that end, Applicant has invented a novel and inventive wastebasket that is specifically adapted to encourage greater reuse of plastic shopping bags by facilitating the reuse of such plastic shopping bags without requiring sacrifice of aesthetically pleasing design features or ease of use.

In particular, it is an object of the present invention to provide a wastebasket specifically adapted to provide convenient storage of and access to plastic shopping bags, thereby making the plastic shopping bags readily available at the time and place where they are most likely to be reused. Additionally, it is an object of the present invention to provide such a wastebasket that is also specifically adapted to present an aesthetically pleasing appearance, thereby ensuring that users will be most likely to want to use the wastebasket.

In more detail, it is an object of the present invention to provide such a wastebasket that provides for complete concealment of stored plastic shopping bags; that provides for the substantial concealment of a plastic shopping bag in use; and that requires no sacrifice of traditional concepts of design and/or décor.

Finally, it is an object of the present invention to provide such a wastebasket that is readily and economically manufactured in a manner intended to be long lasting, thereby ensuring that the wastebasket is widely available to consumers of all means and that the wastebasket itself will not likely become landfill.

SUMMARY OF THE INVENTION

In accordance with the foregoing objects, the present invention—a wastebasket for facilitating reuse of plastic shopping bags—generally comprises a first, open topped receptacle; a second receptacle, sized and shaped to receive therein the first receptacle; and a lid. Although in at least some implementations of the present invention, the first, open topped receptacle may be formed unitary with the second receptacle, in the most preferred implementations of the present invention the first, open topped receptacle is removable from the second receptacle. In any case, the first, open topped receptacle and the second receptacle are cooperatively adapted to form a bag storage compartment generally within the second receptacle and about the outside, upper portions of the first receptacle. Additionally, the lid is cooperatively adapted with the first, open topped receptacle and the second receptacle to form an aesthetically pleasing closure for the bag storage compartment while simultaneously providing an also aesthetically pleasing opening to the interior space of the first, open topped receptacle.

The first, open topped receptacle is sized and shaped to operatively receive a typical plastic shopping bag into the interior space of the receptacle such that, as the main body of the shopping bag conforms into and about the interior space of the receptacle, the upper portions of the shopping bag fold over and about the top edges of the receptacle. When such a typical plastic shopping bag is operatively placed in the receptacle, the lip about the upper portions of the shopping bag will overhang the top edges of the receptacle to be located slightly outside of the interior space of the receptacle. The second receptacle is sized and shaped to receive the first, open-topped receptacle into the second receptacle such that a bag storage compartment is formed generally concentrically about the first receptacle. The lid, in a critical aspect of the present invention, is cooperatively adapted with the first, open-topped receptacle and the second receptacle such that, with the first receptacle operatively received within the second receptacle, the lid closes atop the first receptacle and about the second receptacle to simultaneously: (1) enclose the bag storage compartment; (2) conceal the exterior faces of the first receptacle and the lip about the upper portions of any plastic shopping bag operatively placed in the first receptacle; (3) secure in place, about the top edges of the first receptacle, the upper portions of any plastic shopping bag operatively placed in the first receptacle; and (4) provide an open aperture to the interior space of the main body of any plastic shopping bag operatively placed in the first receptacle.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Figure 1:
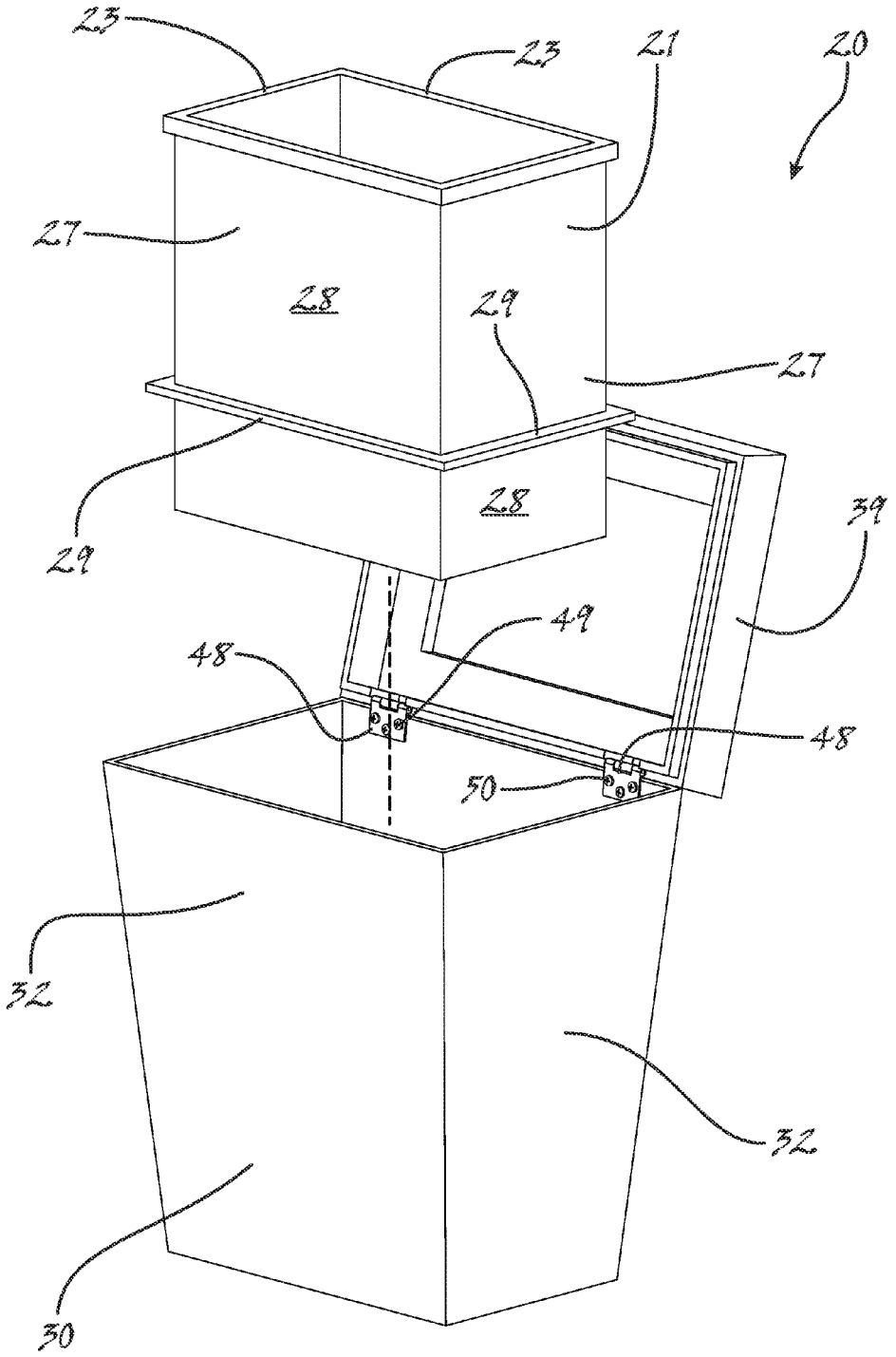
FIG. 1 shows, in a partially exploded perspective view, the preferred implementation of the wastebasket of the present invention and, in particular, shows the most preferred implementations of the first, open topped receptacle, the second receptacle adapted to receive the first receptacle and the lid for the wastebasket, each forming various critical aspects of the wastebasket.
Figure 3:
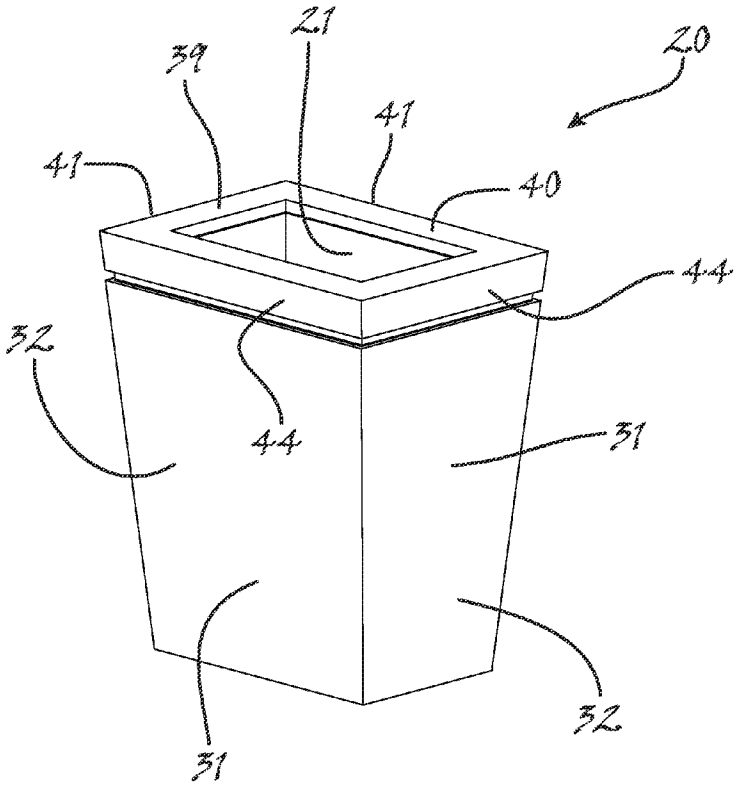
FIG. 3 shows, in a perspective view, the wastebasket of FIG. 1 with the lid thereof in the closed position.
Figure 2:
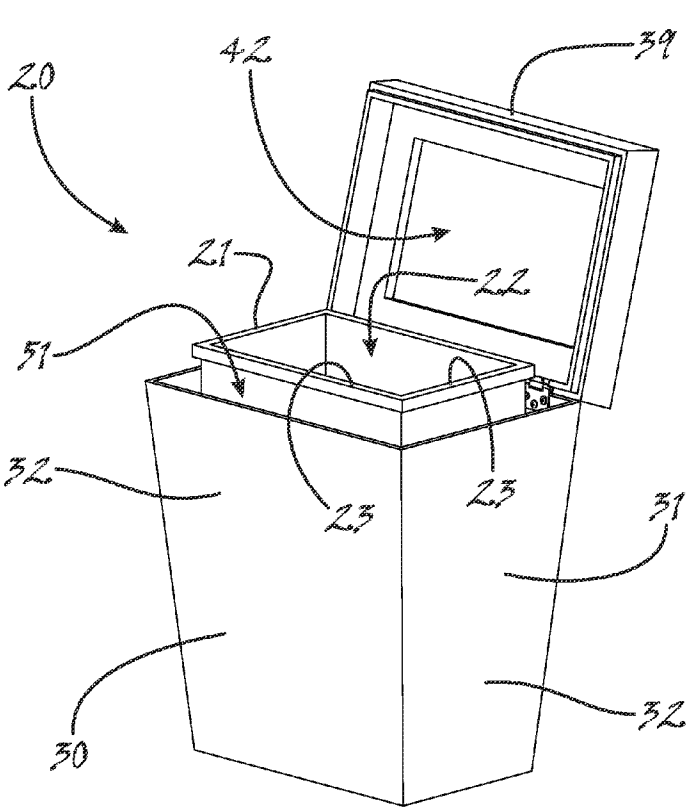
FIG. 2 shows, in a perspective view, the wastebasket of FIG. 1 with the lid thereof in the open position.

Referring then to FIGS. 1 through 3, in particular, the most preferred implementation of the present invention—a wastebasket 20 for facilitating reuse of plastic shopping bags 54—is shown to generally comprise a first, open topped receptacle 21; a second receptacle 30, sized and shaped to receive therein the first receptacle 21; and a lid 39. Although in at least some implementations of the present invention, the first, open topped receptacle 21 may be formed unitary with the second receptacle 30, as will be better understood further herein, in the most preferred implementations of the present invention the first, open topped receptacle 21 is removable from the second receptacle 30, as particularly shown in FIG. 1. In any case, as will be better understood further herein, the first, open topped receptacle 21 and the second receptacle 30 are cooperatively adapted to form a bag storage compartment 51 generally within the second receptacle 30 and about the outside, upper portions of the first receptacle 21, as particularly shown in FIG. 2. Additionally, as particularly shown in FIG. 3 and as also will be better understood further herein, the lid 39 is cooperatively adapted with the first, open topped receptacle 21 and the second receptacle 30 to form an aesthetically pleasing closure for the bag storage compartment 51 while simultaneously providing an also aesthetically pleasing opening to the interior space 22 of the first, open topped receptacle 21.

Figure 16:
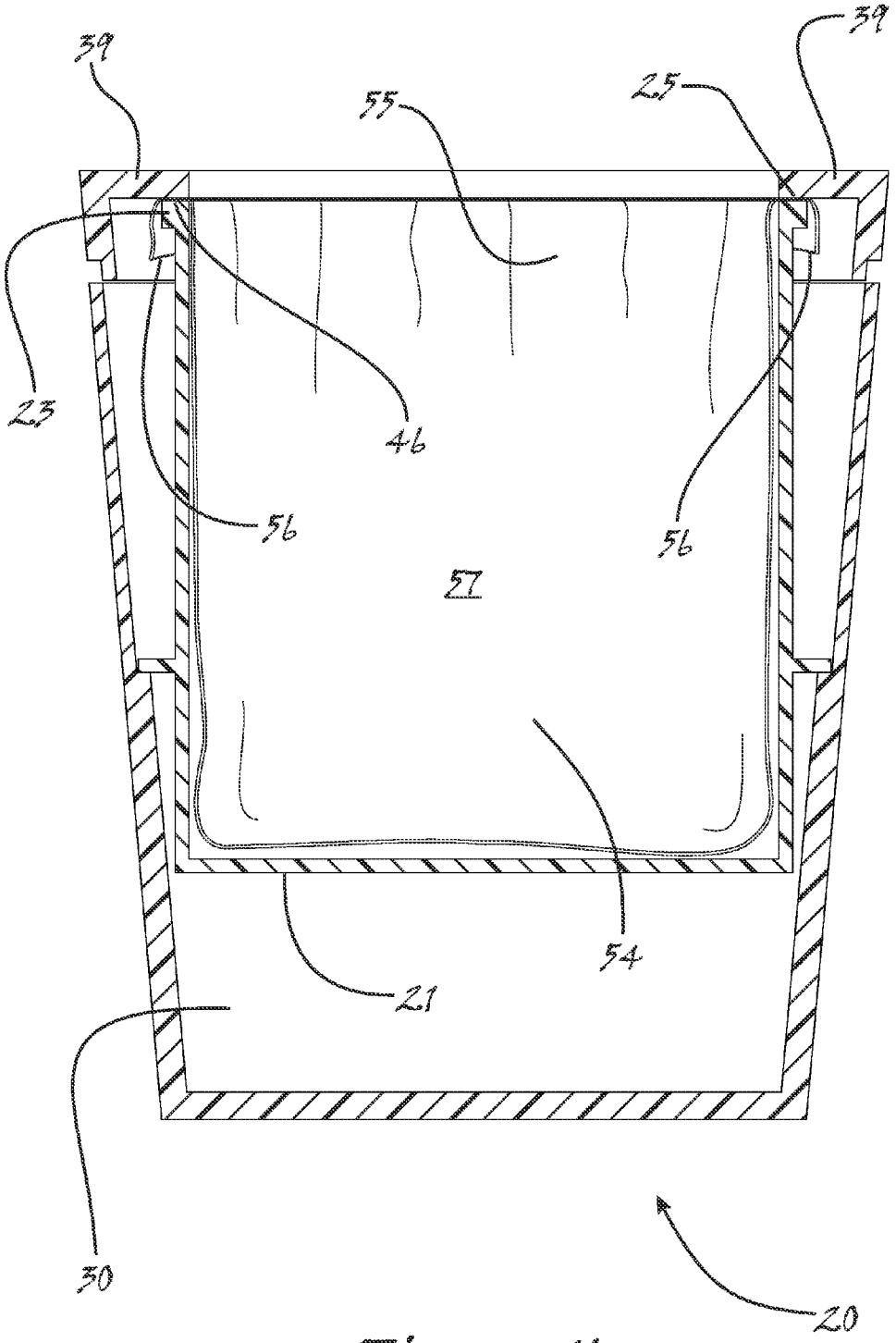
FIG. 16 shows, in the cross-sectional view of FIG. 14, various details of the wastebasket of FIG. 1 with a plastic shopping bag operably disposed therein.
Figure 17:
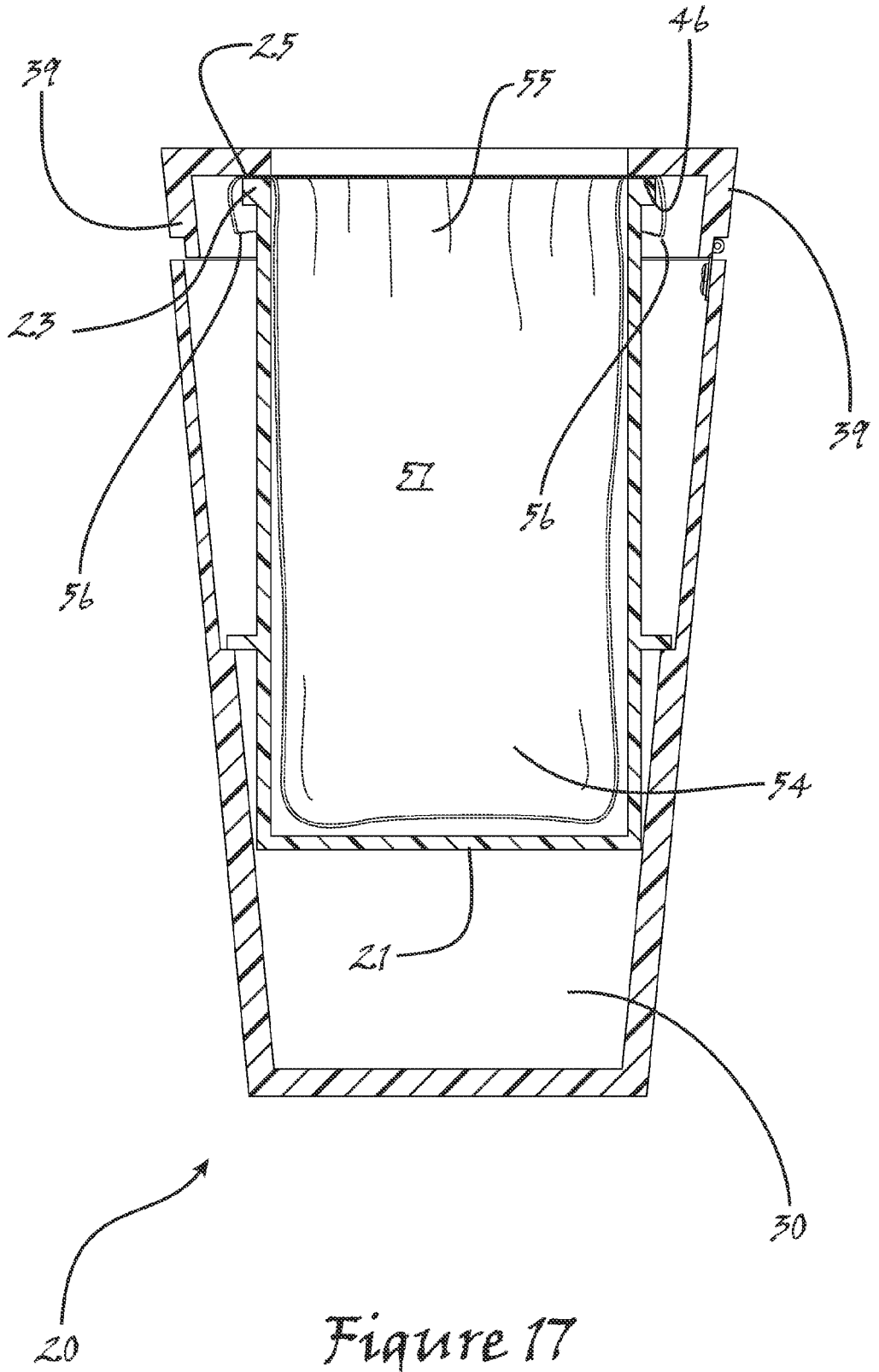
FIG. 17 shows, in the cross-sectional view of FIG. 15, various additional details of the wastebasket of FIG. 1 with a plastic shopping bag operably disposed therein.

As will be better understood further herein, and as generally shown in FIGS. 16 and 17, the first, open topped receptacle 21 is sized and, as necessary, shaped to operatively receive a typical plastic shopping bag 54 into the interior space 22 of the receptacle 21 such that, as the main body 57 of the shopping bag 54 conforms into and about the interior space 22 of the receptacle 21, the upper portions 55 of the shopping bag fold over and about the top edges 23 of the receptacle 21. As can clearly be seen in FIGS. 16 and 17, this arrangement contemplates that, when such a typical plastic shopping bag 54 is operatively placed in the receptacle 21, the lip 56 about the upper portions 55 of the shopping bag 54 will overhang the top edges 23 of the receptacle 21 to be located slightly outside of the interior space 22 of the receptacle 21. As also will be better appreciated further herein, the second receptacle 30 is sized and shaped to receive the first, open-topped receptacle 21 into the second receptacle 30 such that a bag storage compartment 51 is formed generally concentrically about the first receptacle 21. Finally, and as will also be better understood further herein, the lid 39 is, in a critical aspect of the present invention, cooperatively adapted with the first, open-topped receptacle 21 and the second receptacle 30 such that, with the first receptacle 21 operatively received within the second receptacle 30, the lid 39 "closes" atop the first receptacle 21 and about the second receptacle 30 to simultaneously: (1) enclose the bag storage compartment 51; (2) conceal the exterior faces 28 of the first receptacle 21 and the lip 56 about the upper portions 55 of any plastic shopping bag 54 operatively placed in the first receptacle 21; (3) secure in place, about the top edges 23 of the first receptacle 21, the upper portions 55 of any plastic shopping bag 54 operatively placed in the first receptacle 21; and (4) provide an open aperture 42 to the interior space of the main body 57 of any plastic shopping bag 54 operatively placed in the first receptacle 21.

Figure 5:
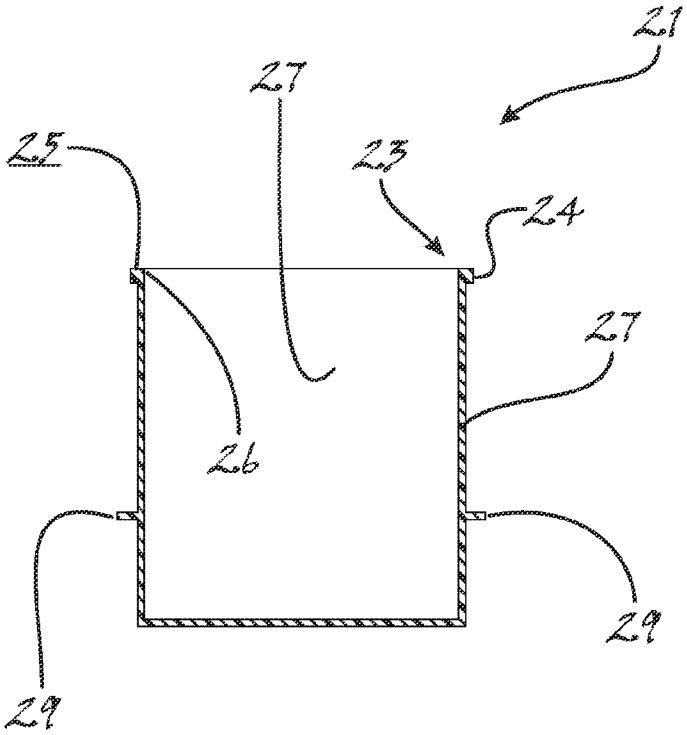
FIG. 5 shows, in a cross-sectional view taken through cut line 5-5 of FIG. 4, various details of the receptacle of FIG. 4.
Figure 4:
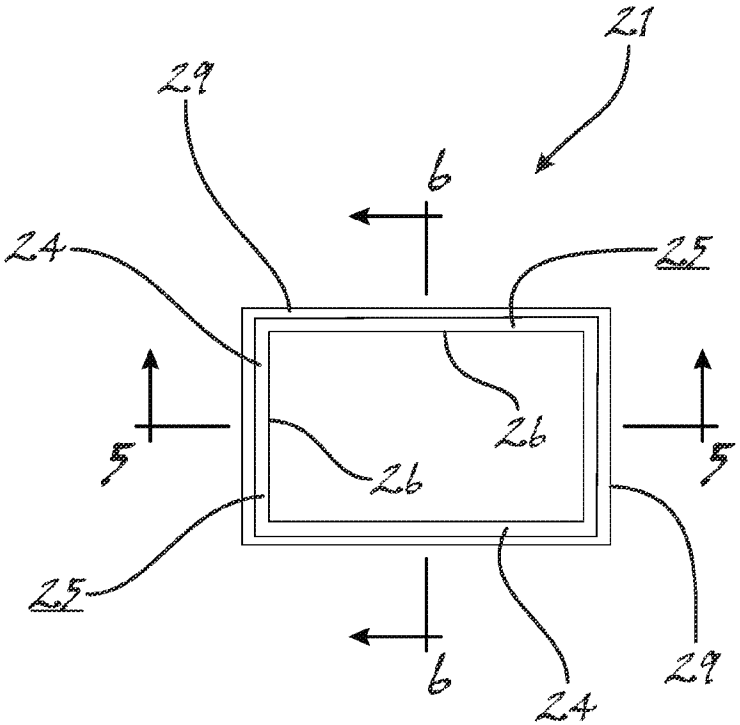
FIG. 4 shows, in a top plan view, the most preferred implementation of the first, open topped receptacle of the wastebasket of the present invention.
Figure 6:
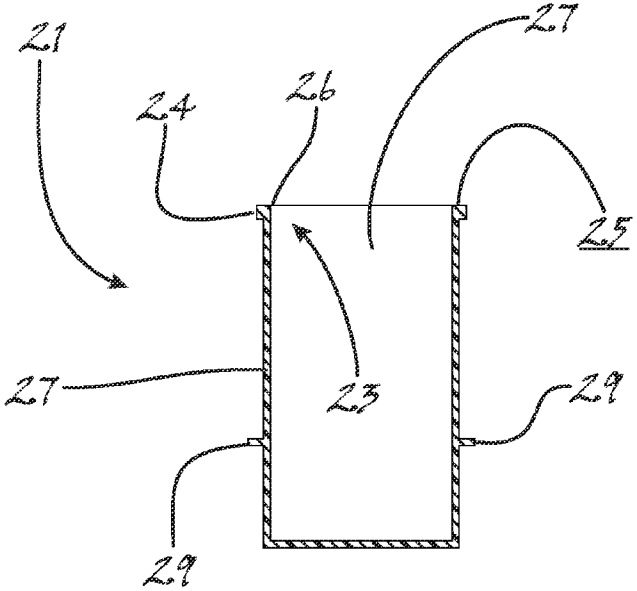
FIG. 6 shows, in a cross-sectional view taken through cut line 6-6 of FIG. 4, various additional details of the receptacle of FIG. 4.

Referring then to FIGS. 4 through 6, in particular, various features of the most preferred embodiment of the first, open-topped receptacle 21 component of the present invention, as implemented in accordance with the foregoing general discussion of the most critical aspects of the wastebasket 20 of the present invention, are now described in greater detail. As previously discussed, the first, open topped receptacle 21 is sized and, as necessary, shaped to operatively receive a typical plastic shopping bag 54 into the interior space 22 of the receptacle 21 such that, as the main body 57 of the shopping bag 54 conforms into and about the interior space 22 of the receptacle 21, the upper portions 55 of the shopping bag fold over and about the top edges 23 of the receptacle 21. As will be appreciated by those of ordinary skill in the art, however, the upper portions 55 of the plastic shopping bag 54 may to this end be slightly stretched to fit snuggly over and about the top edges 23 of the receptacle 21. In any case, as shown in the figures, Applicant has found that the first receptacle 21 is readily manufactured as a generally rectilinear container. In particular, Applicant has found it suitable, within all critical aspects of the present invention, that the receptacle 21 comprises a plurality of generally vertical walls 27 extending upwardly from a rectangular shaped, planar base and terminating in a perimetrical lip 24 defining a rectangular shaped opening to the top of the receptacle 21. As shown in the figures, the most preferred implementation of the first, open-topped receptacle 21 contemplates that the so defined opening at the top of the receptacle 21 will generally correspond in size and orientation to the shape of the planar base.

Those of ordinary skill in the art will recognize in light of this exemplary description (including the foregoing discussions and the discussions to follow, as well), that many alternative shapes for the first, open topped receptacle 21 may, within the critical aspects of the present invention, be implemented. For example, those of ordinary skill in the art will recognize that the wastebasket 20 of the present invention may readily be implemented about a first, open-topped receptacle 21 having an oval horizontal cross section or, with some sacrifice in the "fit" of the most typical plastic shopping bag 54 expected to be operatively placed therein, the first, open-topped receptacle 21 may have a square, circular or other shape horizontal cross section. In any case, however, as shown in FIGS. 16 and 17, the first, open-topped receptacle 21 should be sized and shaped such that, when the particular type of plastic shopping bag 54 for which is adapted a given implementation of the wastebasket 20 of the present invention is operatively placed in the receptacle 21, the lip 56 about the upper portions 55 of the shopping bag 54 will overhang the top edges 23 of the receptacle 21 so as to be located slightly outside of the interior space 22 of the receptacle 21 while the main body 57 of the shopping bag 54 conforms into and about the interior space 22 of the receptacle 21. To this end, Applicant has found that the first receptacle 21, rectilinearly formed in the manner generally depicted in FIGS. 4 through 6 to receive a quite typical plastic shopping bag 54, is suitably manufactured to provide an interior space 22 having the general shape of a rectangular cuboid measuring approximately 10.75 in.×6.5 in. in horizontal cross section and approximately 12 in. top to bottom in depth.

Although those of ordinary skill in the art will recognize in light of this exemplary description (including the foregoing discussions and the discussions to follow, as well), that many alternative methodologies of manufacture may be utilized, Applicant has found that the first, open topped receptacle 21 may, within the critical aspects of the present invention, be both suitably and readily manufactured by injection or other plastics molding methods, such as are generally well known to those of ordinary skill in the art. In such a case, however, it is most preferable that the first, open topped receptacle 21 be formed of a plastics material that is economically obtainable and easily worked, but also exhibits excellent strength and toughness characteristics, is resistant to chemical damage, particularly including damage from oils and the like, and has a high melting point and low coefficient of thermal expansion. To this end, Applicant has found that the first, open topped receptacle 21 may suitably and readily be formed by injection or like molding of polyamide 66 or a like material. In the alternative, however, and as previously mentioned, it is again noted that the first receptacle 21 may also, to more or less advantage, be formed by other techniques and of other materials, such as, for example, steel, aluminum, wood, fiberboard or the like.

Figure 7:
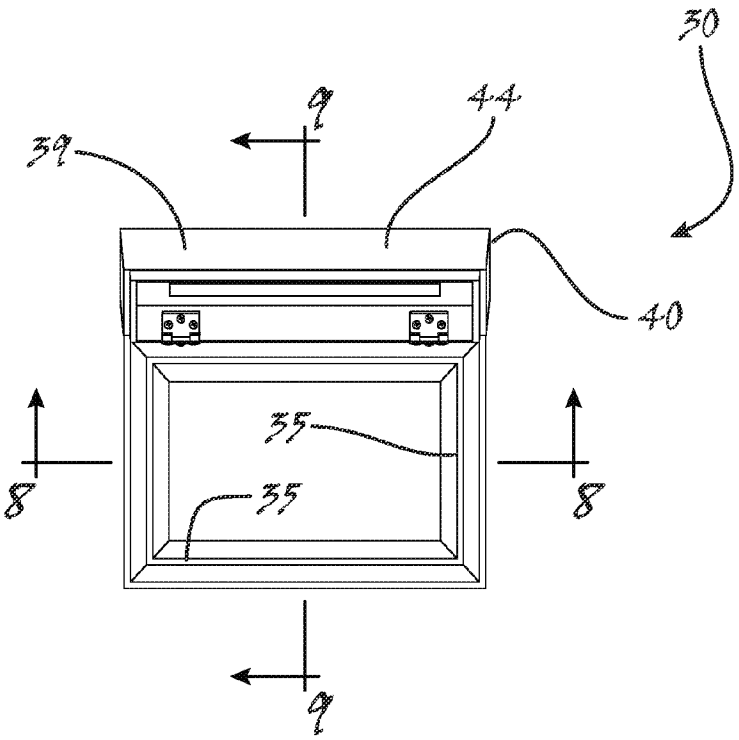
FIG. 7 shows, in a top plan view, the most preferred implementations of the second receptacle adapted to receive the first receptacle and the lid for the wastebasket and, in particular, shows the second receptacle with the lid for the wastebasket in the open position.
Figure 9:
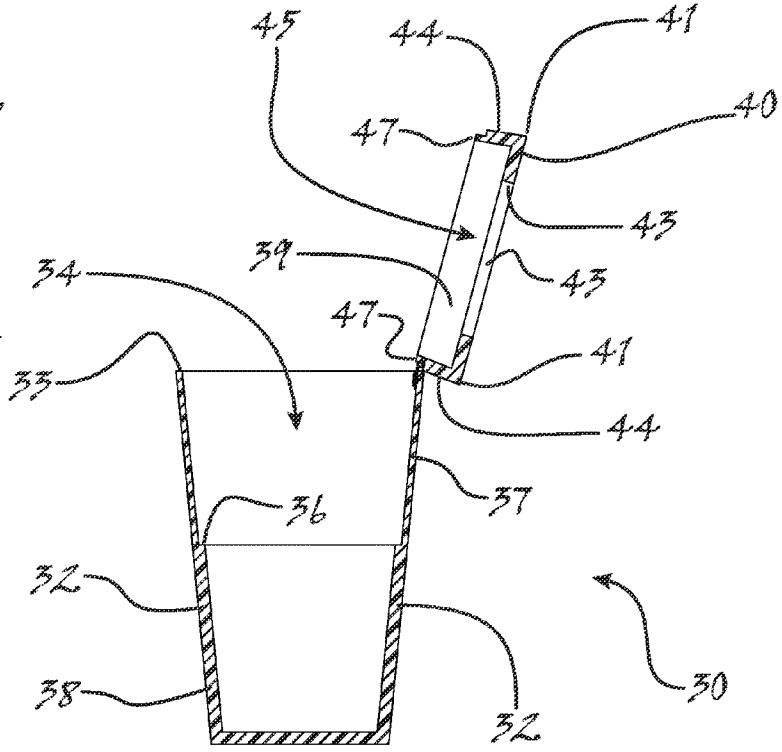
FIG. 9 shows, in a cross-sectional view taken through cut line 9-9 of FIG. 7, various additional details of the receptacle and lid of FIG. 7.
Figure 8:
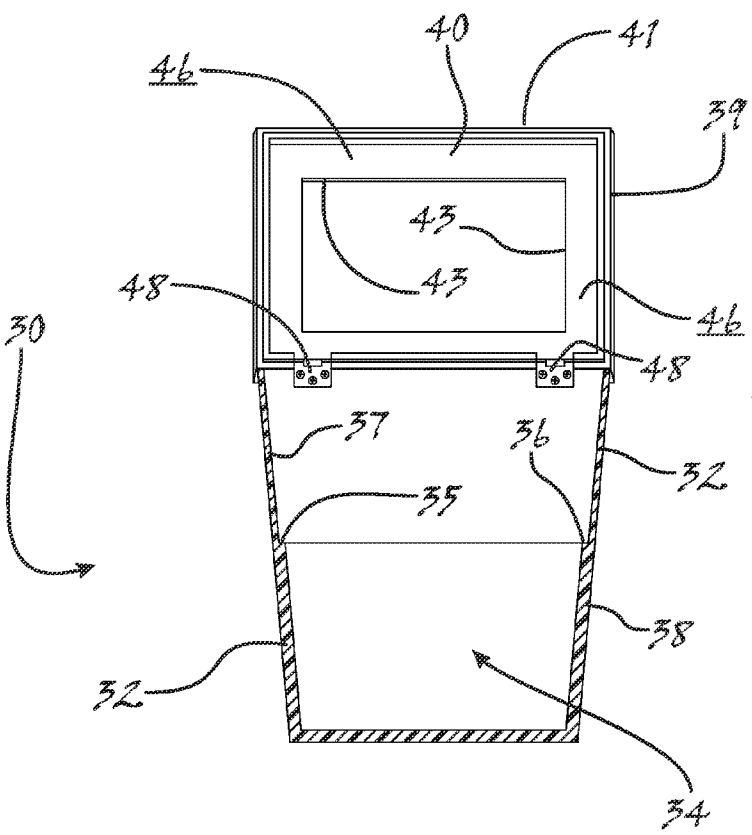
FIG. 8 shows, in a cross-sectional view taken through cut line 8-8 of FIG. 7, various details of the receptacle and lid of FIG. 7.

Referring then to FIGS. 7 through 9, in particular, various features of the most preferred embodiment of the second receptacle 30 component of the present invention and various features of the most preferred embodiment of the lid 39 component of the present invention, as implemented in accordance with the foregoing general discussion of the most critical aspects of the wastebasket 20 of the present invention, are now described in greater detail. Turning first to the second receptacle 30, as previously discussed, the second receptacle 30 is sized and shaped to receive the first, open-topped receptacle 21 into the interior space 34 of the second receptacle 30 such that a bag storage compartment 51 is formed generally concentrically about the first receptacle 21. To this end, as shown in the figures, Applicant has found that the second receptacle 30 is readily manufactured as a generally rectilinear container. In particular, Applicant has found it suitable, within all critical aspects of the present invention, that the receptacle 30 comprises a plurality of generally vertical walls 32 extending upwardly from a rectangular shaped, planar base and terminating in top edges 33 defining a rectangular shaped opening to the top of the receptacle 30. As shown in the figures, the most preferred implementation of the second receptacle 30 contemplates that the so defined opening at the top of the receptacle 30 will generally correspond in orientation to the shape of the planar base. As also shown in the figures, however, the most preferred implementation of the second receptacle 30 contemplates that the size of the so defined opening at the top of the receptacle 30 will not necessarily correspond in size to the shape of the planar base and, in the most preferred implementations of the present invention will in fact be larger, thereby producing a slight tilt in the generally vertical walls 32 of the second receptacle 30. In addition to aspects of the present invention that will be better understood further herein, this provision results in formation by the second receptacle 30 of an aesthetic covering 31, which aesthetic covering 31 substantially encases the first receptacle 21, as particularly shown in FIGS. 2 and 3.

Figure 11:
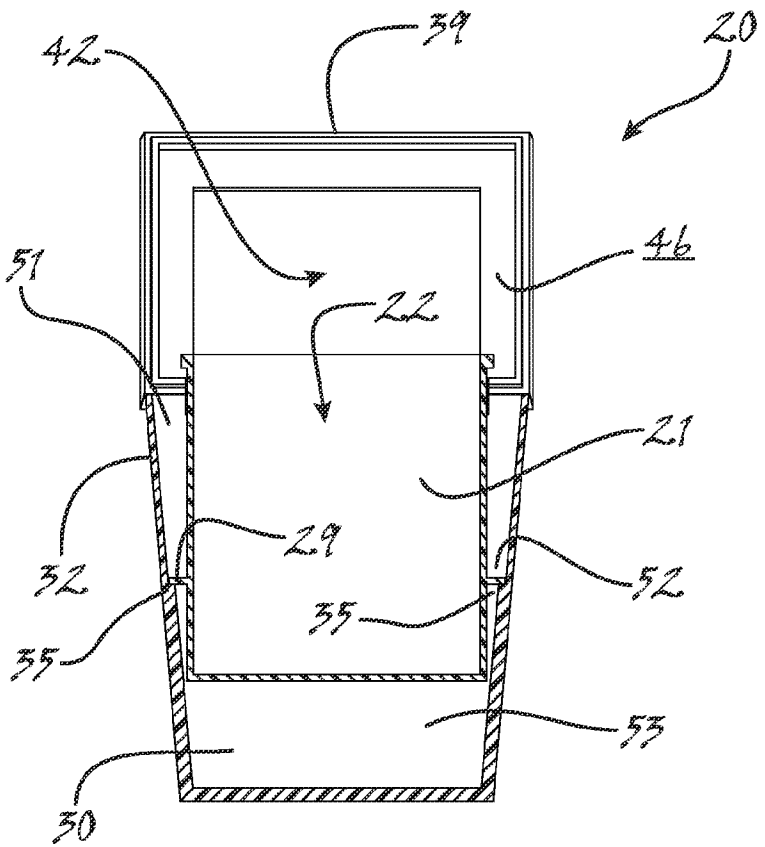
FIG. 11 shows, in a cross-sectional view taken through cut line 11-11 of FIG. 10, various details of the wastebasket of FIG. 1 as depicted in FIG. 2.
Figure 10:
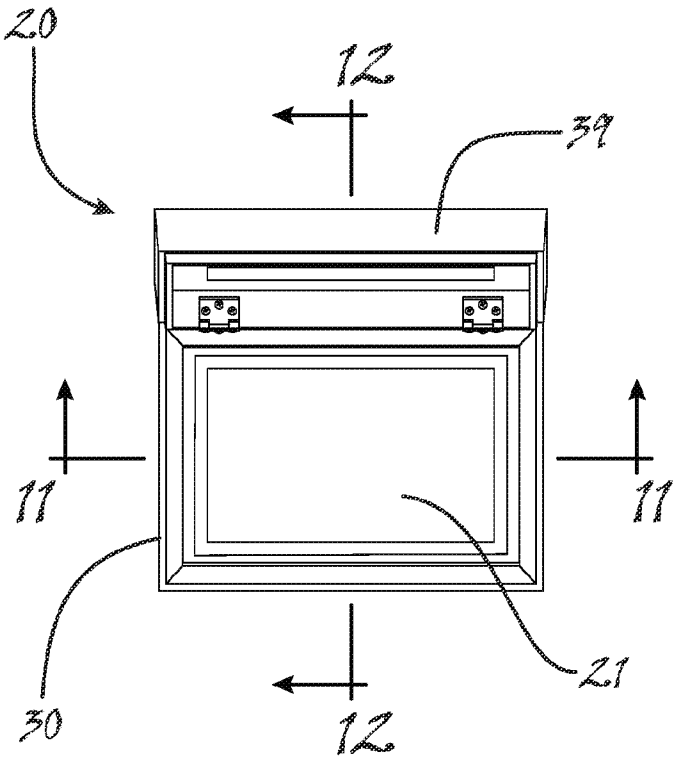
FIG. 10 shows, in a top plan view, the most preferred implementation of the wastebasket of FIG. 1 as depicted in FIG. 2 with the lid thereof in the open position.
Figure 13:
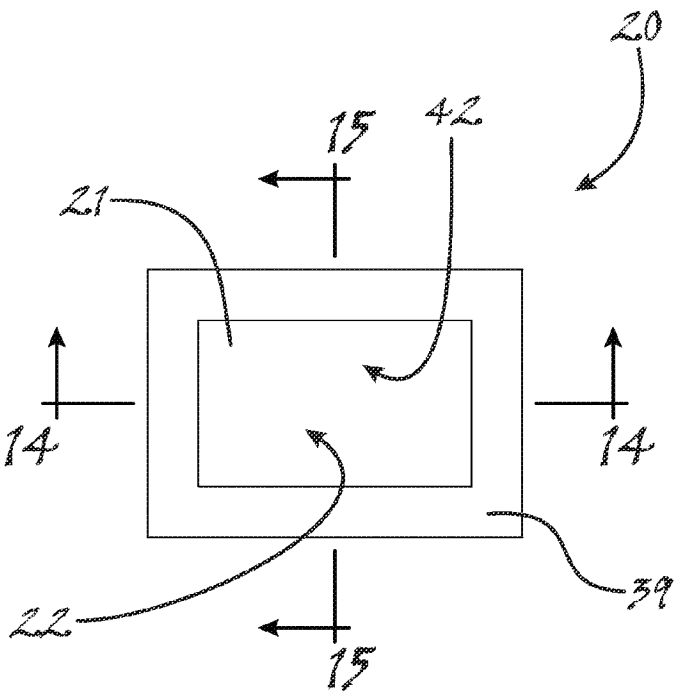
FIG. 13 shows, in a top plan view, the most preferred implementation of the wastebasket of FIG. 1 as depicted in FIG. 3 with the lid thereof in the closed position.
Figure 12:
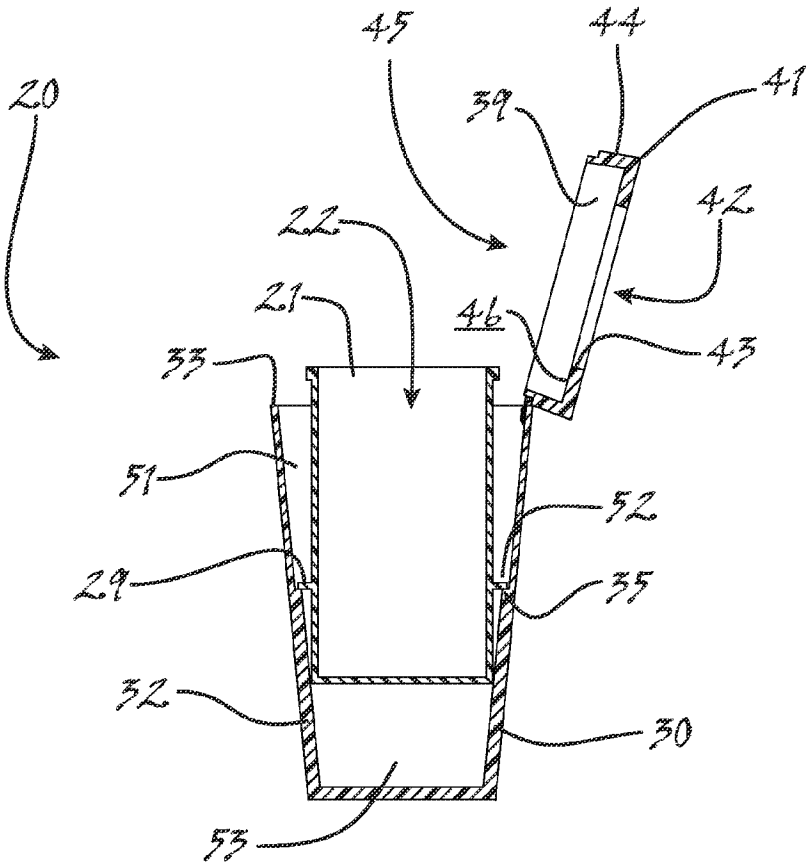
FIG. 12 shows, in a cross-sectional view taken through cut line 12-12 of FIG. 10, various additional details of the wastebasket of FIG. 1 as depicted in FIG. 2.
Figure 15:
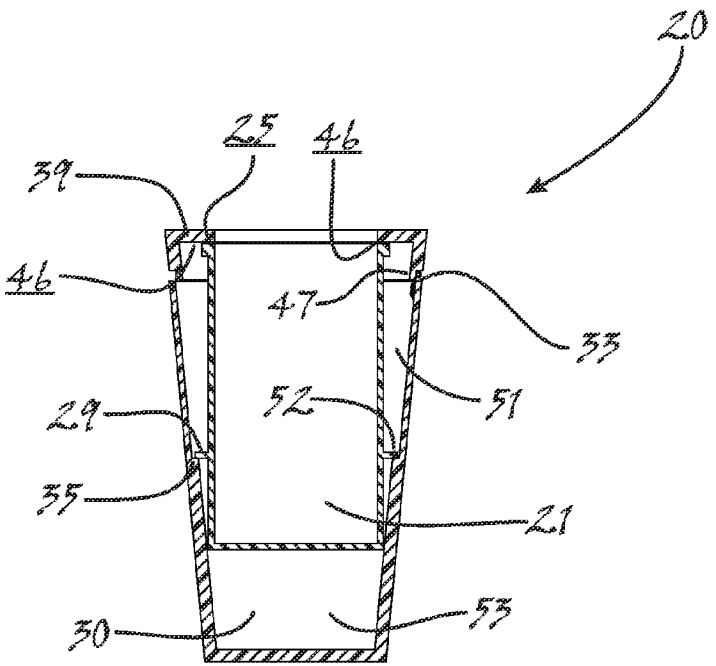
FIG. 15 shows, in a cross-sectional view taken through cut line 15-15 of FIG. 13, various additional details of the wastebasket of FIG. 1 as depicted in FIG. 2.
Figure 14:
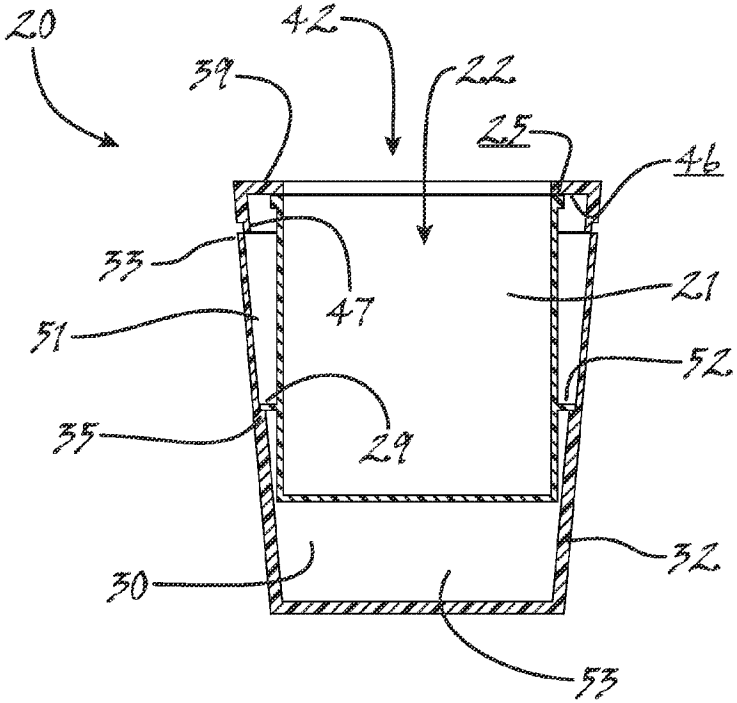
FIG. 14 shows, in a cross-sectional view taken through cut line 14-14 of FIG. 13, various details of the wastebasket of FIG. 1 as depicted in FIG. 2.

Those of ordinary skill in the art will recognize in light of this exemplary description (including the foregoing discussions and the discussions to follow, as well), that many alternative shapes for the second receptacle 30 may, within the critical aspects of the present invention, be implemented subject to conformity with shape of the first, open-topped receptacle 21. In any case, however, as shown in FIGS. 10 through 12, the second receptacle 30 should be sized and shaped such that, when the first, open-topped receptacle 21 is received within the interior space 34 of the second receptacle 30 (whether by insertion, as generally shown in the figures, or, in the alternative, by unitary construction), the first, open topped receptacle 21 and the second receptacle 30 are cooperatively adapted to form a bag storage compartment 51 generally within the second receptacle 30 and about the outside, upper portions of the first receptacle 21. In order to preserve the aesthetic characteristics of the wastebasket 20 of the present invention, and as previously mentioned, the bag storage compartment 51 is most preferably formed generally concentrically about the first receptacle 21. For clarity, as used herein the term "concentric" or variants thereof should be taken to mean that, for any two "concentric" structures, a horizontal slice through one structure will generally have the same shape and orientation as will the other about a common center point. Additionally, the resulting bag storage compartment 51 should be sized, shaped and otherwise formed to: (1) provide adequate storage for plastic bags 54 awaiting reuse and (2) provide ready access to such stored bags 54 for retrieval by a user of the wastebasket 20 of the present invention.

To this end, the opening to the top of the bag storage compartment 51 should, in its most narrow dimension, be sufficiently wide as to readily accommodate the thickness in the metacarpal region of a typical human hand. Likewise, the bag storage compartment 51 should be no deeper than can be readily accessed by at least the fingertips of a typical user seeking to retrieve a stored plastic bag 54 from the compartment 51, which depth, of course, will vary according to the implemented minimum width of the opening to the top of the bag storage compartment 51. With these considerations in mind, and also with a view toward maintaining the overall pleasing aesthetic of the wastebasket 20 of the present invention, Applicant has (for the wastebasket 20 implemented with a first, open topped receptacle 21 sized and shaped as previously described) found that the opening to the top of the bag storage compartment 51 should in its most narrow dimension be at least approximately 1.5 in. wide and that the bag storage compartment 51 should be approximately 7 in. deep as measured from the top edges 33 of the second receptacle to the false bottom 52 of the bag storage compartment 51. In keeping with the foregoing constraints, then, Applicant has found that the second receptacle 30, rectilinearly formed in the manner generally depicted in FIGS. 4 through 6 to receive a first, open topped receptacle 21 as sized, shaped and otherwise formed as previously described, is suitably manufactured to comprise an interior space 34 having the general shape of rectangular trapezoidal trough measuring approximately 14.75 in.×10.5 in. in horizontal cross section at the opening to the top of the receptacle 30, approximately 11.75 in.×7.5 in. in horizontal cross section at the base of the receptacle 30 and approximately 15.25 in. in depth top to bottom.

Although those of ordinary skill in the art will recognize in light of this exemplary description (including the foregoing discussions and the discussions to follow, as well), that many alternative methodologies of manufacture may be utilized, Applicant has found that the second receptacle 30 may, within the critical aspects of the present invention, be both suitably and readily manufactured by injection or other plastics molding methods, such as are generally well known to those of ordinary skill in the art. In such a case, however, it is most preferable that the second receptacle 30 be formed of a plastics material that is economically obtainable and easily worked, but also exhibits excellent strength and toughness characteristics, is resistant to chemical damage, particularly including damage from oils and the like, and has a high melting point and low coefficient of thermal expansion. To this end, Applicant has found that the second receptacle 30 may suitably and readily be formed by injection or like molding of polyamide 66 or a like material. In the alternative, however, and as previously mentioned, it is again noted that the second receptacle 30 may also, to more or less advantage, be formed by other techniques and of other materials, such as, for example, steel, aluminum, wood, fiberboard or the like. In selecting any such alternative technique and/or material for use in connection with an implementation comprising attachment of the lid 39 to the second receptacle 30, and, in particular, such attachment utilizing hinges 48 or the like, careful consideration should be given to selecting a material that at minimum is of sufficient structural integrity as to adequately support proper mounting of the hinges 48 or the like.

As particularly shown in FIGS. 11 and 12, it is noted that, as each are implemented in accordance with the most preferred embodiments of the wastebasket 20 of the present invention, the first, open topped receptacle 21 is dependently supported, substantially within the interior space 34 of the second receptacle 30, by the second receptacle 30. To this end, as particularly shown in FIGS. 4 through 6, the first, open topped receptacle 21 is provided with an exteriorly oriented protrusion 29, which, as is clearly shown in the figures, frames the receptacle 21 about a horizontal midplane through the receptacle 21 to form a hanger for the receptacle 21, as will be better understood further herein. Likewise, as particularly shown in FIGS. 7 through 9, the second receptacle 30 is provided with an interiorly oriented shelf 35, which, as is clearly shown in the figures, is disposed (preferably continuously disposed) about the inner periphery of the interior faces of the walls 32 of the receptacle 30. As particularly shown in FIGS. 11 and 12, the shelf 35 provided within the interior space 34 of the second receptacle 30 is sized, positioned and otherwise adapted to engage with and dependently support the protrusion 29 about the first receptacle 21 whereby the first, open topped receptacle 21 is, in its operable position, dependently supported by the second receptacle 30 substantially within the interior space 34 of the second receptacle 30. As those of ordinary skill in the art will appreciate in light of this exemplary description (including the foregoing discussions and the discussions to follow, as well), the shelf 35 is, in accordance with this aspect of the present invention, oriented in a midplane through the second receptacle 30 parallel to the plane defined by the protrusion 29 about the first receptacle 21.

As previously mentioned, the first, open topped receptacle 21 may be formed unitary with the second receptacle 30 or, as in the most preferred implementation of the wastebasket 20 of the present invention, the first, open topped receptacle 21 may be selectively separable from the second receptacle 30. In all cases, however, appropriate provision should be made to provide the bag storage compartment 51 with a false bottom 52 (or the substantial equivalent thereof) such that the bag storage compartment 51 is formed with an appropriate depth, as previously discussed in detail, notwithstanding the generally much greater depths top to bottom of both the interior space 22 of the first, open topped receptacle 21 and the interior space 34 of the second receptacle 30. That said, the most preferred implementations of the present invention will comprise provision of a first, open topped receptacle 21 that is selectively removable from the second receptacle 30, wherein the false bottom 52 for the bag storage compartment 51 is provided by the overlapping of the interiorly oriented shelf 35 of the second receptacle 30 by the exteriorly oriented protrusion 29 of the first receptacle 21. In the alternative, however, in implementations of the present invention comprising a first, open topped receptacle 21 formed unitary with the second receptacle 30, the false bottom 52 for the bag storage compartment 51 may be implemented by providing an exteriorly oriented protrusion 29 about the first, open topped receptacle 21 that is permanently affixed to the interior faces of the walls 32 of the second receptacle 30.

As those of ordinary skill in the art will appreciate in light of this exemplary description (including the foregoing discussions and the discussions to follow, as well), implementations of the wastebasket 20 of the present invention comprising a first, open topped receptacle 21 that is selectively separable from the second receptacle 30 provide the further advantage of complete and unconstrained access by a user into and about the bag storage compartment 51, which, of course, will greatly facilitate cleaning as may be necessary as a result of inadvertent liquid spills and the like. Additionally, provision of a removable first receptacle 21 will be very useful in a case where, due to leakage of an operably placed plastic shopping bag 54 or the introduction thereto of a particularly noxious substance or a similar occurrence, a user finds it desirable to "dump" the first receptacle 21, in which case the prior separation of the first receptacle 21 from the second receptacle 30 will: (1) make easier the handling of the lesser mass and (2) obviate the need to first remove any stored plastic shopping bags 54 from the bag storage compartment 51 as a protective measure against inadvertent dumping or contamination of any such plastic shopping bags 54. Still further, provision of a removable first receptacle 21 also provides a user with access to a supplemental compartment 53 within the lowermost portion of the interior space 34 of the second receptacle 30, beneath the first receptacle 21, as most particularly shown in FIGS. 11, 12, 14 and 15. While it is to be expected that a user of the wastebasket 20 of the present invention will not routinely desire access to the supplemental compartment 53, the supplemental compartment 53 is nonetheless particularly useful as a hidden storage compartment. Additionally, the provision of an accessible supplemental compartment 53 in the lowermost portion of the wastebasket 20 (as depicted in the figures) is of great advantage in facilitating out of doors or high traffic area use of the wastebasket 20. In particular, a wastebasket 20 implemented in accordance with the present invention to have such an accessible supplemental compartment 53 may be "weighted" down, such as, for example, by introducing a sandbag, beanbag or other object or objects into the supplemental compartment 53, thereby making the wastebasket less susceptible to being knocked over by wind, contact with passersby or the like. As those of ordinary skill in the art will appreciate in light of this exemplary description (including the foregoing discussions and the discussions to follow, as well), the ability to remove such introduced objects, when such introduced objects are not necessary in the foregoing uses, is also of substantial advantage inasmuch as removal of the introduced objects lessens the overall weight of the wastebasket 20 of the present invention, thereby making easier or otherwise facilitating the handling, transportation and/or the like of the wastebasket 20.

In any such implementation of the wastebasket 20 of the present invention comprising a first, open topped receptacle 21 that is selectively separable from the second receptacle 30, it is most preferred that the first, open topped receptacle 21 is easily inserted into, and removed from, the second receptacle 30. Additionally, in any such implementation, it is most preferred that provision be made to positively align the first, open topped receptacle 21 operatively in place within the interior space 34 of the second receptacle 30, which, as will be better understood further herein, will greatly facilitate the critical cooperative adaptation of the first, open topped receptacle 21, the second receptacle 30 and the lid 39 for (1) enclosing the bag storage compartment 51; (2) concealing the exterior faces 28 of the first receptacle 21 and the lip 56 about the upper portions 55 of any plastic shopping bag 54 operatively placed in the first receptacle 21; (3) securing in place, about the top edges 23 of the first receptacle 21, the upper portions 55 of any plastic shopping bag 54 operatively placed in the first receptacle 21; and (4) providing an open aperture 42 to the interior space of the main body 57 of any plastic shopping bag 54 operatively placed in the first receptacle 21.

To these ends, and as previously mentioned, the generally vertical walls 32 of the second receptacle 30 are preferably formed to have a slight tilt such that the horizontal cross section of the interior space 34 of the second receptacle gradually decreases from top to bottom of the second receptacle. As particularly shown in FIGS. 7 through 9, a step discontinuity in this otherwise gradual decrease forms a shoulder 36 separating the upper wall portions 37 of the second receptacle from the lower wall portions 38 of the second receptacle 30. As those of ordinary skill in the art will appreciate in light of this exemplary description (including the foregoing discussions and the discussions to follow, as well), the resulting shoulder 36 forms the interiorly oriented shelf 35, which, as is most preferred, is continuously disposed about the inner periphery of the interior faces of the generally vertical (albeit slightly sloped as discussed herein) walls 32 of the second receptacle 30. Still further, however, the exteriorly oriented protrusion 29 framing the first, open topped receptacle 21, is sized and shaped such that the protrusion 29 extends outward from the exterior faces 28 of the first, open topped receptacle 21 a distance just short of reaching the interior faces of the generally vertical walls 32 of the second receptacle 30 when the first, open topped receptacle 21 is operatively in place within the interior space 34 of the second receptacle 30, i.e., the first, open topped receptacle 21 is being dependently supported by the second receptacle 30, as previously described, and the first, open topped receptacle 21 is horizontally centered with respect to the second receptacle 30. As those of ordinary skill in the art will appreciate in light of this exemplary description (including the foregoing discussions and the discussions to follow, as well), this arrangement allows the first, open topped receptacle 21 to be easily inserted into, and removed from, the second receptacle 30, with little or no chance of binding or the like, and additionally, results in self-centering of the first, open topped receptacle 21 with respect to the second receptacle 30 simultaneously with contact between the protrusion 29 about the first, open topped receptacle 21 and the shelf 35 about the inner space 34 of the second receptacle 30. In an additional benefit, however, it is noted that formation of the second receptacle 30 as previously described also admits well of injection molding. In particular, as those of ordinary skill in the art will appreciate in light of this exemplary description (including the foregoing discussions and the discussions to follow, as well), the sloping as depicted of the walls 32 of the second receptacle allows for the ready release of an injection or like mold notwithstanding that an interiorly oriented shelf 35 is operably required.

In all embodiments of the wastebasket 20 of the present invention, i.e. those with unitarily formed first and second receptacles 21, 30 as well as those with separable first and second receptacles 21, 30, it is generally preferred that, when the first, open topped receptacle 21 is operably positioned within the interior space 34 of the second receptacle 30, the perimetrical lip 24 about the top edges 23 of the first, open topped receptacle 21 should be a distance above the top edges 33 of the second receptacle 30, as particularly shown in FIG. 2. In this manner, as particularly shown in FIGS. 16 and 17, the top edges 23 of the first, open topped receptacle 21 are elevated above the bag storage compartment 51 such that the upper portion 55 of a plastic shopping bag 54 may be easily placed in operable position over and about the perimetrical lip 24 about the top edges 23 of the first, open topped receptacle 21, as will be better understood further herein, without interference from other plastic shopping bags 54 being stored in the bag storage compartment 51 for later use. Additionally, Applicant has found that the resulting "tiered" appearance of this arrangement also contributes to the overall pleasing aesthetic produced by the wastebasket 20 of the present invention. As previously mentioned, the present invention contemplates that, when a typical plastic shopping bag 54 is operatively placed in the first, open topped receptacle 21, the lip 56 about the upper portions 55 of the shopping bag 54 will overhang the top edges 23 of the receptacle 21 to be located slightly outside of the interior space 22 of the receptacle 21 and, additionally, that the lid 39 is adapted to close atop the first receptacle 21 so as to secure in place, about the top edges 23 of the first receptacle 21, the upper portions 55 of any plastic shopping bag 54 operatively placed in the first receptacle 21. As a result, as will be better understood further herein, it is generally preferred that the perimetrical lip 24 about the top edges 23 of all embodiments of the first, open topped receptacle should comprise a substantially planar top surface 25, as particularly shown in FIGS. 4 through 6, thereby increasing the frictional engagement between the top edges 23 of the first, open topped receptacle 21 and the upper portions 55 of an operably placed plastic shopping bag 54.

Returning to FIGS. 7 through 9, in particular, to turn next then to the lid 39, as previously discussed, the lid 39 is, in a critical aspect of the present invention, cooperatively adapted with the first, open-topped receptacle 21 and the second receptacle 30 such that, with the first receptacle 21 operatively received within the second receptacle 30, the lid 39 "closes" atop the first receptacle 21 and about second receptacle 30 to simultaneously: (1) enclose the bag storage compartment 51; (2) conceal the exterior faces 28 of the first receptacle 21 and the lip 56 about the upper portions 55 of any plastic shopping bag 54 operatively placed in the first receptacle 21; (3) secure in place, about the top edges 23 of the first receptacle 21, the upper portions 55 of any plastic shopping bag 54 operatively placed in the first receptacle 21; and (4) provide an open aperture 42 to the interior space of the main body 57 of a plastic shopping bag 54 operatively placed in the first receptacle 21. To this end, as shown in the figures. Applicant has found that the lid 39 is readily manufactured as a generally rectilinear cap. In particular, Applicant has found it suitable, within all critical aspects of the present invention, that the lid 39 comprises a plurality of generally vertical sides 44 disposed about and projecting downwardly from the outer edges 41 of rectangular shaped, planar top 40 having a rectangular shaped open aperture 42 provided generally centrally therethrough such that the top 40 comprises a substantially planar undersurface 46 bounding the entire perimeter of the centrally provided open aperture 42. As particularly shown in FIGS. 14 and 15, the centrally provided open aperture 42 through the top 40 of the lid 39 is sized and shaped such that the edges 43 about the open aperture 42 closely conform in size and shape to the inside corners 26 of the perimetrical lip 24 about the top edges 23 of the first, open topped receptacle 21.

As shown in the figures, the lid 39 is in this manner formed to have a generally concave underside 45 such that, when the lid 39 is operably positioned atop the first receptacle 21 and about the second receptacle 30 (as each is in its operable position with respect to the other, as particularly shown in FIGS. 13 through 17), the substantially planar undersurface 46 of the top 40 of the lid 39 will generally uniformly contact the substantially planar top surface 25 of the perimetrical lip 24 about the top edges 23 of the first, open topped receptacle 21 (or the upper portions 55 of any plastic shopping bag 54 operatively placed over the top surface 25 of the perimetrical lip 24 about the top edges 23 of the first, open topped receptacle 21) and, simultaneously, the bottom edges 47 of the downwardly projecting sides 44 of the lid 39 will generally uniformly lie atop, aside, about or otherwise adjacent the top edges 33 of the generally vertical walls 32 of the second receptacle 30. Additionally, however, the open aperture 42 will simultaneously frame the opening to the interior space 22 of the first, open topped receptacle 21 (or to the interior space of the main body 57 of any plastic shopping bag 54 operatively placed in the first receptacle 21). As those of ordinary skill in the art will appreciate in light of this exemplary description (including the foregoing discussions and the discussions to follow, as well), and as particularly shown in FIGS. 13 through 17, this cooperative arrangement of the lid 39 and the first and second receptacles 21, 30 will simultaneously (1) enclose the bag storage compartment (2) conceal the exterior faces 28 of the first receptacle 21 and the lip 56 about the upper portions 55 of any plastic shopping bag 54 operatively placed in the first receptacle 21 as well as most or all of any hinges 48 or like hardware provided, if desired, in connection attachment to the second receptacle 30 of the lid 39; (3) frictionally engage, and thereby secure in place, about the top edges 23 of the first receptacle 21, the upper portions 55 of any plastic shopping bag 54 operatively placed in the first receptacle 21; and (4) provide an open aperture 42 to the interior space of the main body 57 of any plastic shopping bag 54 operatively placed in the first receptacle 21.

Although those of ordinary skill in the art will recognize in light of this exemplary description (including the foregoing discussions and the discussions to follow, as well), that many alternative methodologies of manufacture may be utilized, Applicant has found that the lid 39 may, within the critical aspects of the present invention, be both suitably and readily manufactured by injection or other plastics molding methods, such as are generally well known to those of ordinary skill in the art. In such a case, however, it is most preferable that the lid 39 be formed of a plastics material that is economically obtainable and easily worked, but also exhibits excellent strength and toughness characteristics, is resistant to chemical damage, particularly including damage from oils and the like, and has a high melting point and low coefficient of thermal expansion. To this end, Applicant has found that the lid 39 may suitably and readily be formed by injection or like molding of polyamide 66 or a like material. In the alternative, however, and as previously mentioned, it is again noted that the lid 39 may also, to more or less advantage, be formed by other techniques and of other materials, such as, for example, steel, aluminum, wood, fiberboard or the like.

It is noted, however, that in at least some implementations of the wastebasket 20 of the present invention it is contemplated that the lid 39 should be attached to the second receptacle with hinges 48 or the like, as particularly shown in FIGS. 1, 2, 7 through 10, 12 and 17. It should be further noted, then, that in most such implementations the hinges will be attached, as also shown in various of these figures, utilizing conventional mounting hardware 49 such as, for example, screws 50 or the like. As a result, in selecting any alternative technique and/or material for use in connection with an implementation comprising attachment of the lid 39 to the second receptacle 30, and, in particular, such attachment utilizing hinges 48 or the like, careful consideration should be given to selecting a material that at minimum is of sufficient structural integrity as to adequately support proper mounting of the hinges 48 or the like.

The wastebasket 20 of the present invention and manner of making the same having thus been fully described according to the best mode known to Applicant, attention is now turned to additional detail of the manner of use of the wastebasket 20 of the present invention. In implementations comprising a first, open topped receptacle 21 that is selectively separable from the second receptacle 30, the user will first determine whether it is desirable to make use of the supplemental compartment 53 (if provided). If so, and if not already separated, the user will simply lift the first, open topped receptacle 21 to separate the first receptacle 21 from the second receptacle 30, as generally shown in FIG. 1. With the first, open topped receptacle 21 separated from the second receptacle 30, the user will place any desired object, such as, for example a valuable or a weight, into the supplemental compartment 53 and, thereafter, place the first, open topped receptacle 21 in its operable position within the interior space 34 of the second receptacle 30, as particularly shown in FIG. 2.

In implementations comprising a first, open topped receptacle 21 that is selectively separable from the second receptacle 30, but where either no supplemental compartment 53 is provided or the user does not wish to make use of a provided supplemental compartment 53, the user will begin by simply ensuring that the first, open topped receptacle 21 is already in its operable position within the interior space 34 of the second receptacle 30, as particularly shown in FIG. 2, or will place the first, open topped receptacle 21 in its operable position within the interior space 34 of the second receptacle 30. In implementations comprising a first, open topped receptacle 21 that is formed unitary with the second receptacle 30, the first, open topped receptacle 21 will, of course, already be in its operable position within the interior space 34 of the second receptacle 30.

In any case, with the first, open topped receptacle 21 in its operable position within the interior space 34 of the second receptacle 30 and with the lid 39 of the wastebasket 20 in its open position, as particularly shown in FIGS. 2 and 10 through 12, a plastic shopping bag 54 is operably fitted in place within and about the first, open topped receptacle 21. As generally shown in FIGS. 16 and 17 (albeit with the lid 39 in the closed position as opposed to the open position as will be the case at this stage of use), the user will in particular arrange the plastic shopping bag 54 such that the main body 57 of the shopping bag 54 conforms into and about the interior space 22 of the receptacle 21 and will fold the upper portions 55 of the shopping bag 54 over and about the top edges 23 of the receptacle 21, slightly stretching the upper portions 55 of the plastic shopping bag 54 as may be necessary, thereby positioning the lip 56 about the upper portions 55 of the shopping bag 54 slightly outside of the interior space 22 of the receptacle 21.

As those of ordinary skill in the art will appreciate in light of this exemplary description (including the foregoing discussions and the discussions to follow, as well), the placed plastic shopping bag 54 may have been conveniently retrieved from a store of plastic shopping bags 54 previously placed in the bag storage compartment 51 of the wastebasket 20 of the present invention or, if the placed plastic shopping bag 54 is the first to be introduced to the wastebasket 20 of the present invention, may have been put directly to use as described. In any case, at this point the lid 39 is then closed, or otherwise placed, atop the first, open topped receptacle 21 and about the second receptacle 30, as particularly shown in FIGS. 16 and 17. With the lid 39 in operable position, the lid 39 and the first and second receptacles 21, 30 will cooperatively simultaneously (1) enclose the bag storage compartment 51; (2) conceal the exterior faces 28 of the first receptacle 21 and the lip 56 about the upper portions 55 of operatively placed plastic shopping bag 54; (3) secure in place, about the top edges 23 of the first receptacle 21, the upper portions 55 of the plastic shopping bag 54; and (4) provide an open aperture 42 to the interior space of the main body 57 of the plastic shopping bag 54.

As particularly shown in FIG. 3, the wastebasket 20 is then placed in service, where the second receptacle 30 presents an aesthetically pleasing covering 31 substantially encasing the first receptacle 21 and the stored plastic shopping bags 54 while simultaneously permitting, through the open aperture 42 of the lid 39, full and unrestricted access to the interior of the plastic shopping bag 54 operably in use. Should the user come into possession of additional plastic shopping bags 54 before an operably placed plastic shopping hag 54 is ready for removal and other disposal, the user will simply open the lid 39 to reveal the bag storage compartment 51 stow the additional plastic shopping bags 54 in the bag storage compartment 51 and then replace the lid 39 to return the wastebasket 20 of the present invention to service. As those of ordinary skill in the art will appreciate in light of this exemplary description, the novel and inventive wastebasket 20 of the present invention is specifically adapted for the promotion of environmentally conscious refuse disposal. In particular, those of ordinary skill in the art will recognize that the advances in the art made by the present invention will go far to encourage greater reuse of plastic shopping bags by facilitating the reuse of such plastic shopping bags without requiring sacrifice of aesthetically pleasing design features or ease of use.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. For example, while the most preferred implementation of the wastebasket 20 of the present invention has been shown in the exemplary depictions to exhibit very strong symmetry, where front and back and left and right side views are essentially the same, those of ordinary skill in the art will recognize that many other aesthetically pleasing ornamental designs for the wastebasket 20 of the present invention are possible.

Additionally, those of ordinary skill in the art will recognize that the bag storage compartment 51 may, in addition to its critical purpose, also be utilized for storage of any other article as may be desired by a user of the wastebasket 20 of the present invention. In any case, because the scope of the present invention is much broader than any particular embodiment, the foregoing detailed description should not be construed as a limitation of the scope of the present invention, which is limited only by the claims appended hereto.

What is claimed is:

1. A wastebasket for facilitating reuse of plastic shopping bags, said wastebasket comprising:

a first receptacle having a closed bottom, said first receptacle comprising:

an upwardly extending wall having a thickness and terminating in a top edge defining an opening into said first receptacle;

a perimetrical lip disposed about said top edge of said wall of said first receptacle, said perimetrical lip comprising a substantially planar top surface having a width greater than said thickness of said upwardly extending wall; and an exteriorly oriented protrusion formed about and framing said first receptacle at a horizontal midplane through said first receptacle, said exteriorly oriented protrusion thereby forming a hanger for said first receptacle;

a second receptacle, said second receptacle comprising:

an upwardly extending wall having an inner periphery and terminating in a top edge defining an opening into said second receptacle; and an interiorly oriented shelf disposed at a horizontal midplane through said second receptacle about said inner periphery of said wall of said second receptacle;

a lid, said lid comprising:

a top having outer edges thereabout and an aperture centrally located therethrough, said aperture having a perimeter sized and shaped to generally align with said planar top surface of said perimetrical lip disposed about said top edge of said wall of said first receptacle;

a sidewall projecting downwardly from said outer edges of said top and terminating in a bottom edge sized and shaped to generally align about said top edge of said wall of said second receptacle; and a substantially planar undersurface;

wherein said second receptacle is sized and shaped to concentrically receive said first receptacle through said opening into said second receptacle such that:

said exteriorly oriented protrusion of said first receptacle rests upon said interiorly oriented shelf of said second receptacle; and with said first receptacle concentrically received within said second receptacle and said exteriorly oriented protrusion of said first receptacle resting upon said interiorly oriented shelf of said second receptacle to form an interface between said exteriorly oriented protrusion of said first receptacle and said interiorly oriented shelf of said second receptacle, said first receptacle and said second receptacle cooperatively form a bag storage compartment about said wall of said first receptacle, between said wall of said first receptacle and said wall of said second receptacle, and above said interface of said exteriorly oriented protrusion of said first receptacle and said interiorly oriented shelf of said second receptacle; and wherein with said first receptacle concentrically received within said second receptacle and said exteriorly oriented protrusion of said first receptacle resting upon said interiorly oriented shelf of said second receptacle, said lid closes such that:

said bottom edge of said downwardly projecting sidewall of said lid rests adjacent said top edge of said wall of said second receptacle; and simultaneously with said bottom edge of said downwardly projecting sidewall of said lid resting adjacent said top edge of said wall of said second receptacle, said substantially planar undersurface of said lid rests substantially uniformly atop said planar top surface of said perimetrical lip disposed about said top edge of said wall of said first receptacle.

2. A wastebasket for facilitating reuse of plastic shopping bags, said wastebasket comprising:

a first receptacle having a closed bottom and comprising an upwardly extending wall having a thickness and terminating in a top edge defining an opening into said first receptacle;

a second receptacle comprising an upwardly extending wall having and an inner periphery and terminating in a top edge defining an opening into said second receptacle;

a lid, said lid comprising:

a top having outer edges thereabout and an aperture centrally located therethrough, said aperture having a perimeter sized and shaped to generally align with said top edge of said wall of said first receptacle;

a sidewall projecting downwardly from said outer edges of said top and terminating in a bottom edge sized and shaped to generally align about said top edge of said wall of said second receptacle; and a substantially planar undersurface; and wherein:

said first receptacle is concentrically affixed within said second receptacle through an exteriorly oriented protrusion formed about and framing said first receptacle at a horizontal midplane through said first receptacle, said exteriorly oriented protrusion being also affixed about said inner periphery of said wall of said second receptacle;

said first receptacle and said second receptacle cooperatively form a bag storage compartment about said wall of said first receptacle, between said wall of said first receptacle and said wall of said second receptacle and above said exteriorly oriented protrusion extending between said first receptacle and said wall of said second receptacle; and said lid closes such that:

said bottom edge of said downwardly projecting sidewall of said lid rests adjacent said top edge of said wall of said second receptacle; and simultaneously with said bottom edge of said downwardly projecting sidewall of said lid resting adjacent said top edge of said wall of said second receptacle, said substantially planar undersurface of said lid rests substantially uniformly atop said top edge of said wall of said first receptacle.

3. The wastebasket for facilitating reuse of plastic shopping bags as recited in claim 2, wherein said first receptacle further comprises a perimetrical lip disposed about said top edge of said wall of said first receptacle.

4. The wastebasket for facilitating reuse of plastic shopping bags as recited in claim 3, wherein said perimetrical lip comprises a substantially planar top surface having a width greater than said thickness of said upwardly extending wall of said first receptacle.

5. A wastebasket for facilitating reuse of plastic shopping bags, said wastebasket comprising:

a first receptacle having a closed bottom, said first receptacle comprising:

an upwardly extending wall terminating in a top edge defining an opening into said first receptacle; and an exteriorly oriented protrusion formed about and framing said first receptacle at a horizontal midplane through said first receptacle, said exteriorly oriented protrusion thereby forming a hanger for said first receptacle;

a second receptacle, said second receptacle comprising:

an upwardly extending wall having an inner periphery and terminating in a top edge defining an opening into said second receptacle; and an interiorly oriented shelf disposed at a horizontal midplane through said second receptacle about said inner periphery of said wall of said second receptacle;

a lid, said lid comprising:

a top having outer edges thereabout and an aperture centrally located therethrough, said aperture having a perimeter sized and shaped to generally align with said wall of said first receptacle;

a sidewall projecting downwardly from said outer edges of said top and terminating in a bottom edge sized and shaped to generally align about said top edge of said wall of said second receptacle; and a substantially planar undersurface;

wherein said second receptacle is sized and shaped to concentrically receive said first receptacle through said opening into said second receptacle such that:

said exteriorly oriented protrusion of said first receptacle rests upon said interiorly oriented shelf of said second receptacle; and with said first receptacle concentrically received within said second receptacle and said exteriorly oriented protrusion of said first receptacle resting upon said interiorly oriented shelf of said second receptacle to form an interface between said exteriorly oriented protrusion of said first receptacle and said interiorly oriented shelf of said second receptacle, said first receptacle and said second receptacle cooperatively form a bag storage compartment about said wall of said first receptacle, between said wall of said first receptacle and said wall of said second receptacle, and above said interface of said exteriorly oriented protrusion of said first receptacle and said interiorly oriented shelf of said second receptacle; and wherein with said first receptacle concentrically received within said second receptacle and said exteriorly oriented protrusion of said first receptacle resting upon said interiorly oriented shelf of said second receptacle, said lid closes such that:

said bottom edge of said downwardly projecting sidewall of said lid rests adjacent said top edge of said wall of said second receptacle; and simultaneously with said bottom edge of said downwardly projecting sidewall of said lid resting adjacent said top edge of said wall of said second receptacle, said substantially planar undersurface of said lid rests substantially uniformly atop said top edge of said wall of said first receptacle.

6. The wastebasket for facilitating reuse of plastic shopping bags as recited in claim 5, wherein said first receptacle further comprises a perimetrical lip disposed about said top edge of said wall of said first receptacle.

* * * * *